US005350345A

United States Patent [19]

Frey

[11] Patent Number: 5,350,345

[45] Date of Patent: Sep. 27, 1994

[54] EXERCISE APPARATUS FOR THE UPPER ARM

[76] Inventor: Mark Frey, 2 Hewlett Rd., New Fairfield, Conn. 06812

[21] Appl. No.: 27,288

[22] Filed: Mar. 4, 1993

[51] Int. Cl.[5] ..... A63B 21/065

[52] U.S. Cl. ..... 482/105; 482/93; 482/108

[58] Field of Search ..... 482/93, 105, 106, 108, 482/109; 602/20, 21; 128/878

[56] References Cited

U.S. PATENT DOCUMENTS

| | | | |
|---|---|---|---|
| 315,512 | 4/1885 | Kearns | 602/21 |
| 1,469,315 | 10/1923 | Hansard | 602/21 X |
| 1,797,057 | 3/1931 | Foulice | 602/21 |
| 2,617,650 | 11/1952 | Landis | 482/108 |
| 2,693,794 | 11/1954 | Neville | 128/878 X |
| 4,109,908 | 9/1978 | Pugh et al. | 482/105 |
| 4,231,569 | 11/1980 | Rae | 482/93 X |
| 4,345,756 | 8/1982 | Hoagland . | |
| 4,585,228 | 4/1986 | Olson . | |
| 4,607,840 | 8/1986 | Harper . | |
| 4,684,122 | 8/1987 | Desmond et al. | 482/108 X |
| 4,798,199 | 1/1989 | Hubbard et al. | 602/21 |
| 4,858,916 | 8/1989 | Beaumont | 482/105 |
| 4,943,052 | 7/1990 | Powers . | |
| 5,058,576 | 10/1991 | Brim et al. | 482/21 |
| 5,110,119 | 5/1992 | Arnold . | |

FOREIGN PATENT DOCUMENTS

| | | | |
|---|---|---|---|
| 116670 | 8/1984 | European Pat. Off. | 482/105 |
| 217608 | 2/1909 | Fed. Rep. of Germany | 482/105 |

*Primary Examiner*—Robert Bahr

*Attorney, Agent, or Firm*—Robin, Blecker, Daley & Driscoll

[57] ABSTRACT

An exercise apparatus for an arm of a user which includes a support having a first part for supporting and extending along a portion of the lower arm of the user and a second part having an outwardly curved portion for supporting the wrist of the user in an extended position to increase the work load on the upper arm or biceps during exercise.

13 Claims, 8 Drawing Sheets

EXERCISE APPARATUS FOR THE UPPER ARM

BACKGROUND OF THE INVENTION

This invention relates to an exercise apparatus and, in particular, to an exercise apparatus adapted to maximize the work load on the upper arm during weight training or body building.

Various types of exercise apparatuses have been developed over the years to form and tone muscular development of the arm. Examples of equipment include free weights, nautilus machines, universal machines, etc., where specific areas of the body, such as the arm, can be focused on and exercised to tone and firm a desired muscular group.

U.S. Pat. No. 4,684,122 to Desmond et al. discloses one example of an exercise apparatus in the form of an exercise cuff with attachments. The exercise cuff is placed around the lower forearm and extends to the wrist of a wearer so as to allow the wearer to perform weight-related exercises. A first attachment extends from the cuff so as to be grippable by the inside of the wearer's hand. This attachment is curved in the hand area to permit lifting or pulling exercises without significant stress on the fingers or hand.

U.S. Pat. No. 5,110,119 to Arnold discloses another exercise apparatus which utilizes an enclosure or support assembly for receiving the lower arm. A clamping assembly supported below the enclosure allows for receipt of a range of free weights for performing a "curl" and "fly" exercise.

In U.S. Pat. No. 4,858,916 to Beaumont, a weighted exercise apparatus is described in which a flat platform is used to support the lower arm and wrist of a user. A strap secures the user's arm to the platform and a gripping bar at the end of the platform is provided for gripping by the user's hand. A series of coaxially aligned adjustable weights are supported by a post positioned on the side of the platform opposite the gripping bar for alignment of the weights to the user's hand. This maintains a desired center of gravity proximate to the gripping bar and concentrates the exertion by the user during exercise.

U.S. Pat. No. 4,607,840 to Harper discloses yet another weight training apparatus in the form of a frame, a handgrip and a bar for mounting weights outward of the handgrip. First and second braces are also provided toward a rearward end of the frame and extend in opposite directions relative to the plane of the frame. These braces engage opposite sides of the user's forearm so that weight training plates can be mounted at an extended distance beyond the hand of the user in order to apply selective leverage against the user's arm.

Although the above-described patents disclose several different ways in which to exercise the upper arm, improved exercise apparatuses are still being sought. Specifically, exercise apparatuses designed to further promote maximum work on the upper arm are still desired by exercise enthusiasts.

It is therefore an object of the present invention to provide an exercise apparatus for the upper arm which permits the biceps muscle to receive maximum muscular contraction and extension.

It is a further object of the present invention to provide an improved exercise apparatus for exercising the upper arm which is easy to attach and use for exercise.

It is a further object of the present invention to provide an exercise apparatus which is economical to manufacture, low in cost and effective for exercising the upper arm.

It is an additional object of the present invention to provide an exercise apparatus which can be used with conventional free weights without requiring additional expensive equipment.

SUMMARY OF THE INVENTION

In accordance with the principles of the present invention, the above and other objectives are realized in an exercise apparatus for exercising the upper arm of a user which includes an elongated support having a first part for supporting and extending along a portion of the lower arm of a user and a second part which extends from the first part and includes an outwardly curved portion for supporting and extending along the wrist and hand of the user. The curved portion of the support places the wrist of the user in an extended or outwardly bent position, thereby increasing the work load on the biceps of the arm during exercise with the apparatus.

In a first embodiment of the exercise apparatus, a grip is attached to the curved portion of the support for providing a handle for the hand of the user by allowing the hand to slide under and grasp the grip. A strap is also provided at the forward end of the first part of the support for securing the support to the arm.

In this embodiment, the second part of the support beyond the outwardly curved portion includes a second or weight support portion which extends downwardly and then curves to form a hook for supporting a weight to be carried by the exercise apparatus.

In a second embodiment of the exercise apparatus, the second part of the support includes a second or weight support portion in the area of the outwardly curved portion which is adapted to support a weight and which is further adapted to provide a grip for the hand of the user. The weight support portion includes opposed plates which receive a bar which can be gripped by the hand and which supports weights at its opposite ends.

In a third embodiment of the exercise apparatus, connecting means joins together two apparatuses of the invention so that both arms can be exercised at once.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
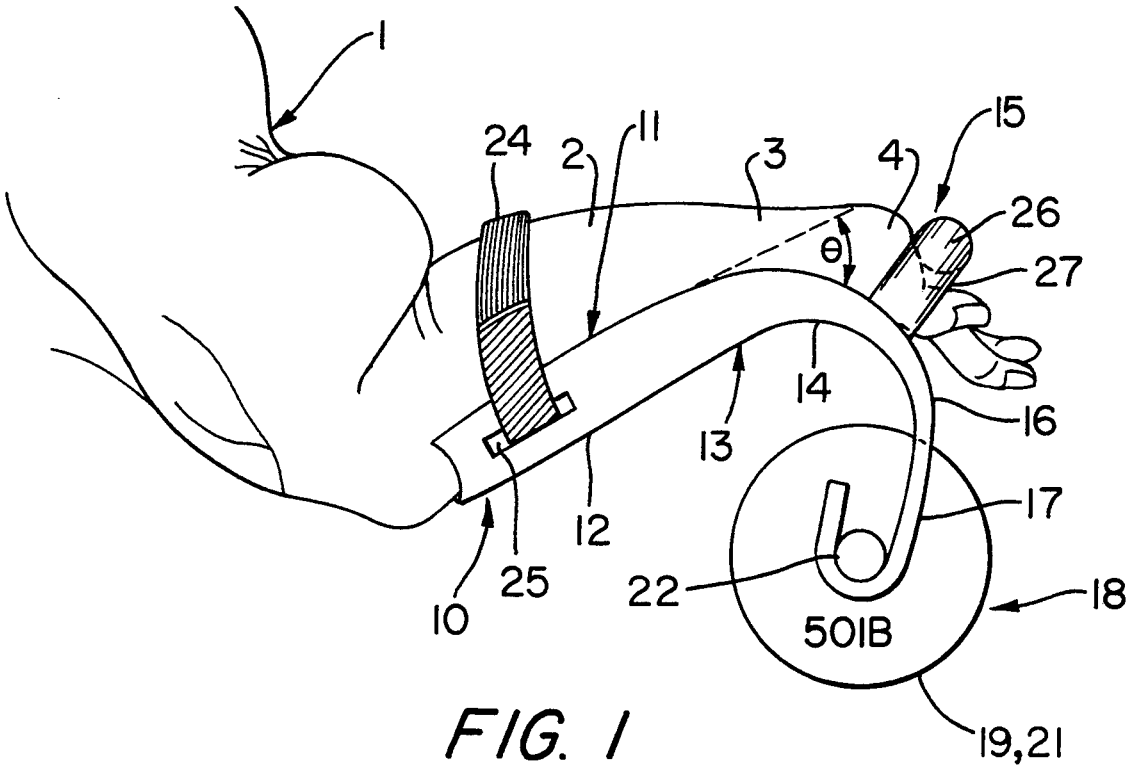
FIG. 1 shows a perspective view of an exercise apparatus for the upper arm in accordance with the principles of the present invention.
Figure 2:
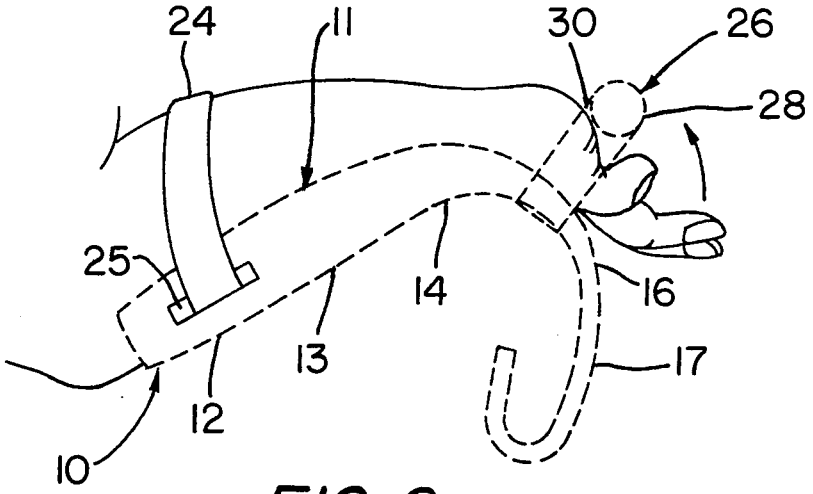
FIG. 2 shows a view of a portion of the exercise apparatus of FIG. 1.

FIG. 1 shows an exercise apparatus 10 in accordance with the principles of the invention. The apparatus 10 includes an elongated support 11 which has a first part 12, shown as substantially straight, which extends along the lower arm 2 of a user 1. The support 11 further includes a second part 13 which has a first portion 14 for supporting the wrist 3 and hand 4 of the user.

In accord with invention, the first portion 14 of the support part 13 is curved or bent outwardly so that the wrist of the user is flexed outwardly when supported in the exercise apparatus. The forward end of the outwardly curved portion 14 provides support for the user's hand and is provided with a grip 15. The contour and length of the outwardly curved portion 14 and the positioning of the grip 15 places the wrist of the user when supported in the exercise apparatus 10 in a substantially maximum outwardly bent condition. This causes substantially full extension of the wrist and, as a result, provides maximum contractions, extension, and reflection of the user's biceps when the user moves his or her forearm up and down, i.e., curls, with the exercise apparatus 10.

Figure 3:
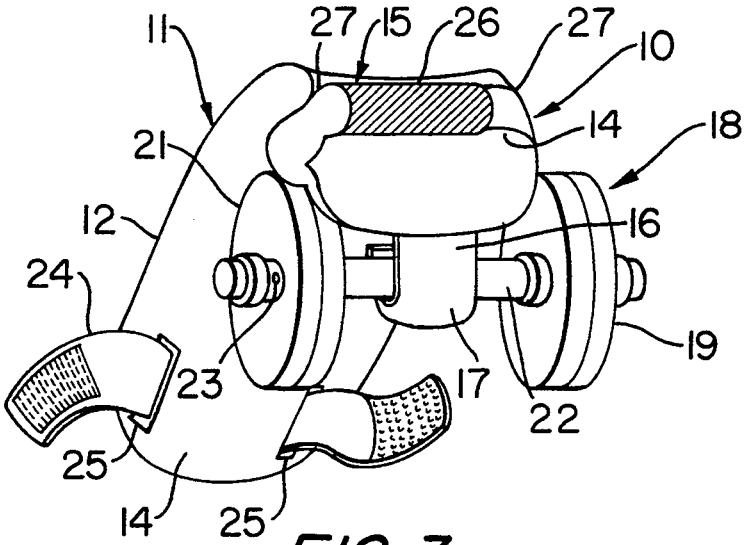
FIGS. 3 and 4 show frontal views of the exercise apparatus of FIG. 1 with and without a weight attached thereto.

A second weight support portion 16 of the support part 13 extends downwardly from the curved portion 14 and ends in a hook-shaped section 17 which allows for placement of a weight 18. The weight 18 may comprise a variety of forms and shapes, such a tubular, circular, rectangular, etc., as long as the weight can be held in place or position by the hook-shaped section 17. In the present illustrative case, the weight 18 is a barbell shape having circular weights 19 and 21 placed on either end of a cylindrical shaft 22 and secured thereon by fasteners 23. (see FIGS. 1 and 3).

Figure 4:
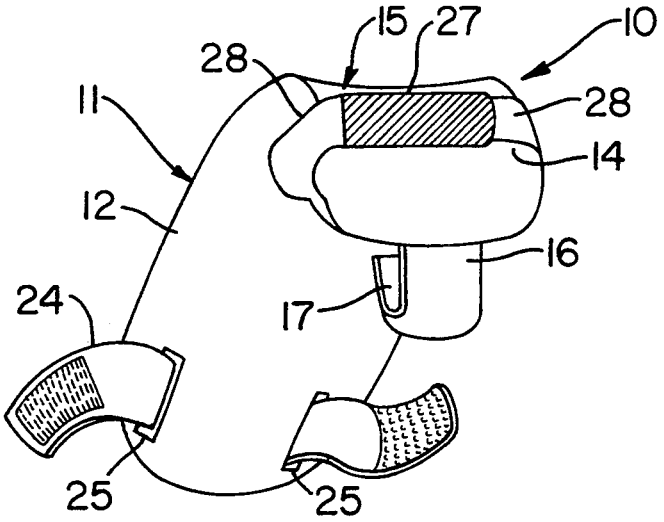

While a maximum effect is realized with weights supported on the apparatus 10, the apparatus may be used without weights as shown in FIG. 4 and still obtain exercise benefits. This is so because the extension of the wrist still occurs even without weight placement due to the outward bend of the wrist support portion 14.

To hold the support 11 to the user's arm an attachment means, shown as straps 24, are provided and pass through slots 25 in the arm support part 12 of the support 11. Other forms of the attachment means, such as, bindings, ties, clamps or the like may be used. The attachment means should be positioned on the arm support part 12 to provide adequate balancing between the support part 12 and any weight 18 positioned in the hook-shaped portion 17 so that the support part 12 rests comfortably against the user's arm 2.

As above-noted, the grip 15 is provided on the outwardly curved portion 4 for gripping by the user's hand and to help maintain extension of the wrist during exercising. The grip 15 includes a handle 26 under which the hand slides and extensions 27 which support the handle in spaced relationship to the curved portion 14. The extensions 27 are attached to opposite sides of the portion 14 through any convenient means, such as, for example, fasteners, bolts, locking means or the like.

With the exercise apparatus 10 attached to the lower arm of the user 1, the arm of the user is first held in a fully extended down position. The user then curls the arm so that the hand 4 and lower arm 2 are brought up and toward the chest. The user then with a steady motion uncurls the arm to lower the hand 4 and the lower am 2 downward and away from the body. During these motions, the user's wrist 3 remains outwardly bent and fully extended due to the outwardly curved portion 14 of the support part 13. As a result, maximum exertion of the biceps muscle occurs.

The support 11 of the exercise apparatus 10 may be made of metal, wood, plastic or the like rigid material. Semi-flexible materials might also be used as long as the material provides enough support to maintain its shape along the lower arm of the user, while also providing enough foundation to support the weight 18 being placed in the hook-shaped portion 17.

FIGS. 5–8 illustrate a second embodiment of the exercise apparatus of the invention. In this embodiment, the parts which are the same as those in the embodiment of FIG. 1 have been identified with like reference numerals augmented by the letter "A." More particularly, in this embodiment, the exercise apparatus 10A includes a support 11A having a first part 12A for extending along the lower arm of a user. The support 11A also includes a second part 13A having an outwardly bent portion 14A for supporting the wrist of a user in extended position.

A second or weight support portion 15A of the part 13A comprises a cylindrical bar 41 (see, FIG. 6) which extends through apertures 42 in opposing upstanding plates 43, 44 attached to opposite sides of the support portion 15A. Weights 45, 46 secured by a clamp 47 are then placed on the outer ends of the bar 41 as desired by the user.

In this case, the bar 41 also serves as a grip for the exercise apparatus 10A and the user's hand slides under the bar 41 and then is grasped by the user. Again the positioning of the bar and outwardly curved or bent section 14A of the support 11A are such that the user's wrist is bent outwardly when using the apparatus to exercise the arm. The wrist is thus kept in an extended position to maximize the work load on the upper am or biceps during exercise.

In the apparatus of FIGS. 5–8, the support 11A is attached to the user's arm with a curved metallic strap 48. This strap is bolted by fasteners 49 to the side extensions 50 on the first part 12A of the support, as shown.

Figure 5:
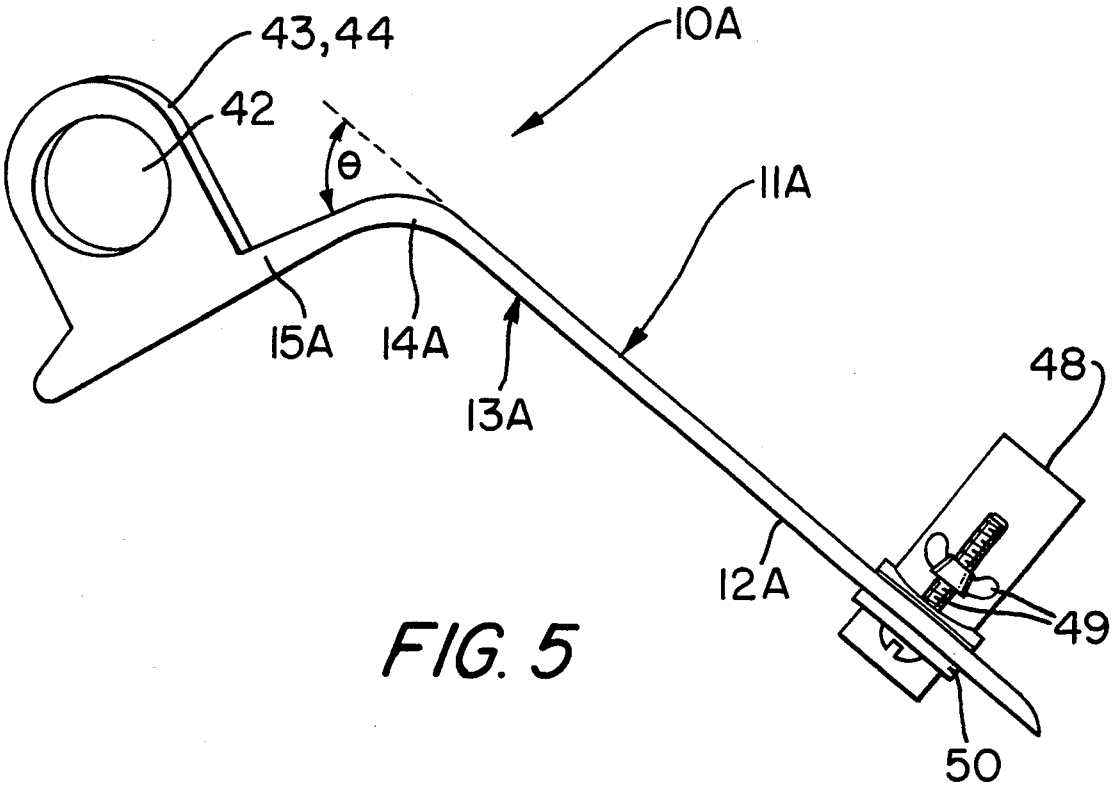
FIG. 5 shows a view of a second embodiment of an exercise apparatus for the upper arm in accordance with the principles of the present invention.
Figure 6:
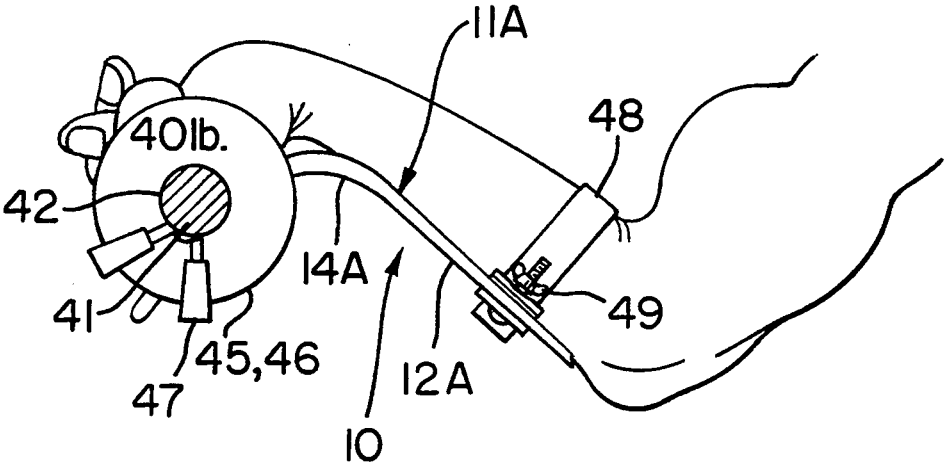
FIG. 6 illustrates the exercise apparatus of FIG. 5 attached to the lower arm of a user.
Figure 7:
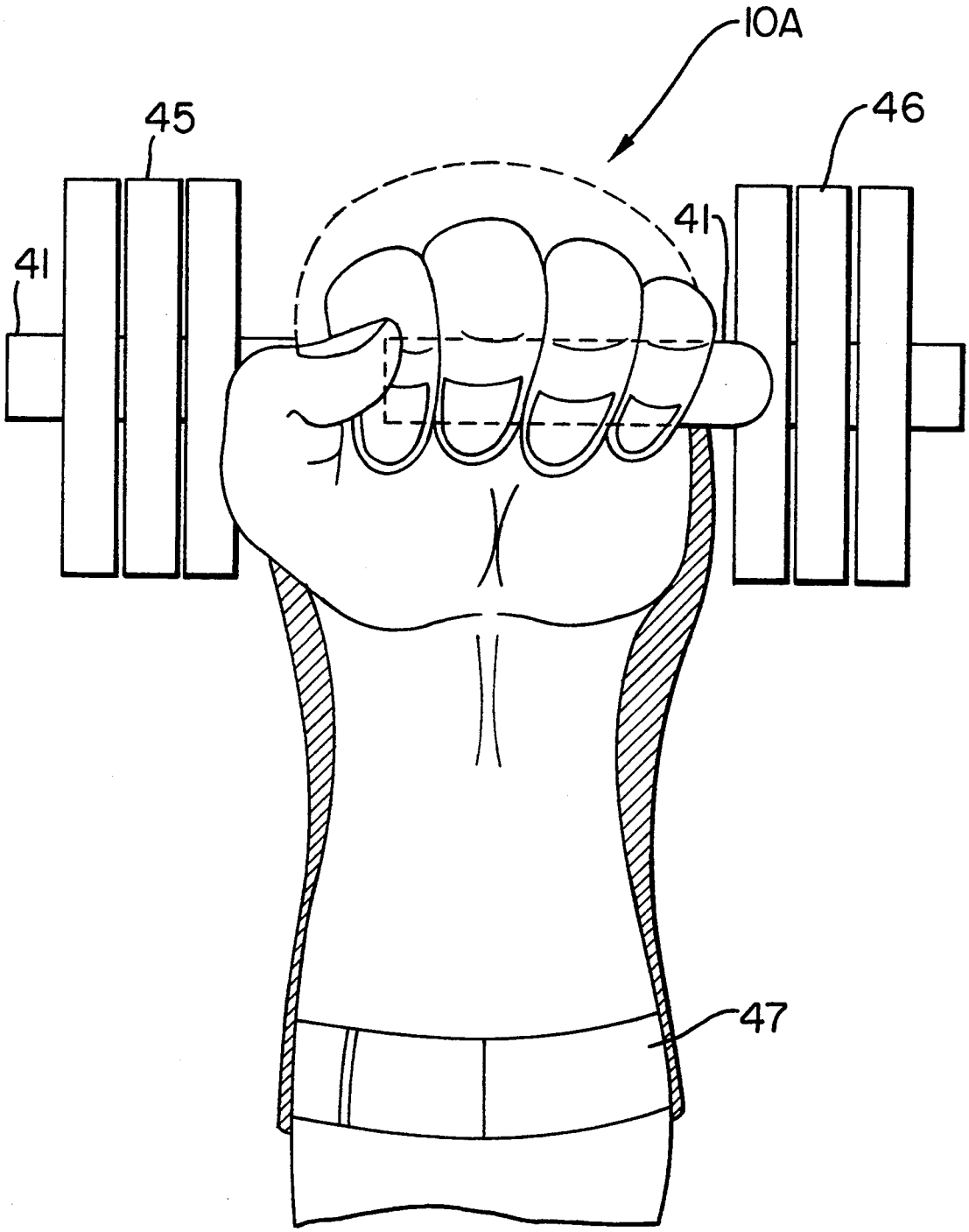
FIG. 7 shows a frontal view of the exercise apparatus of FIG. 5.
Figure 8:
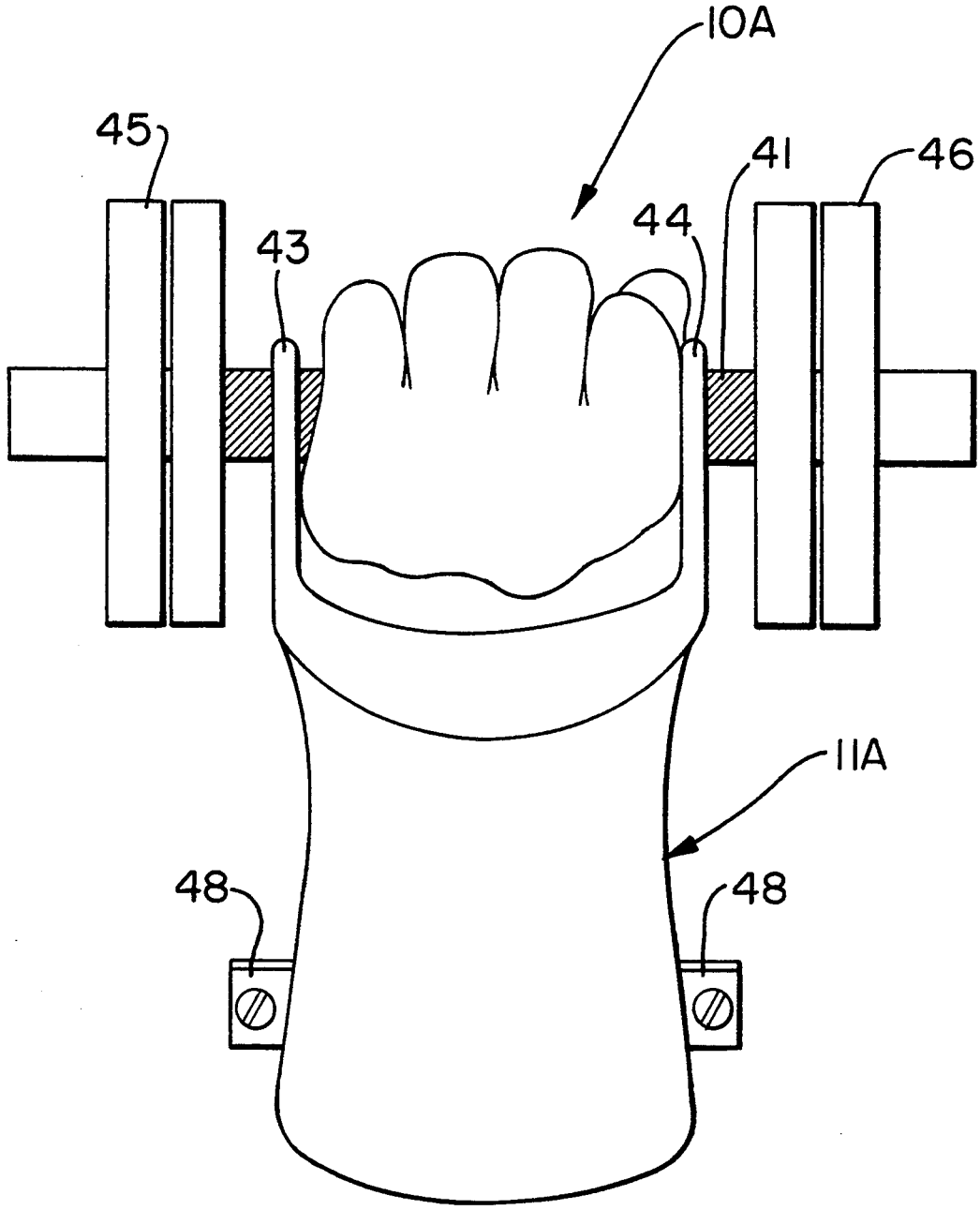
FIG. 8 shows a back view of the exercise apparatus of FIG. 5.

FIGS. 7 and 8 show frontal and back views of the FIGS. 5–6 apparatus. These views illustrate the placement of the user's hand in the apparatus.

Figure 9:
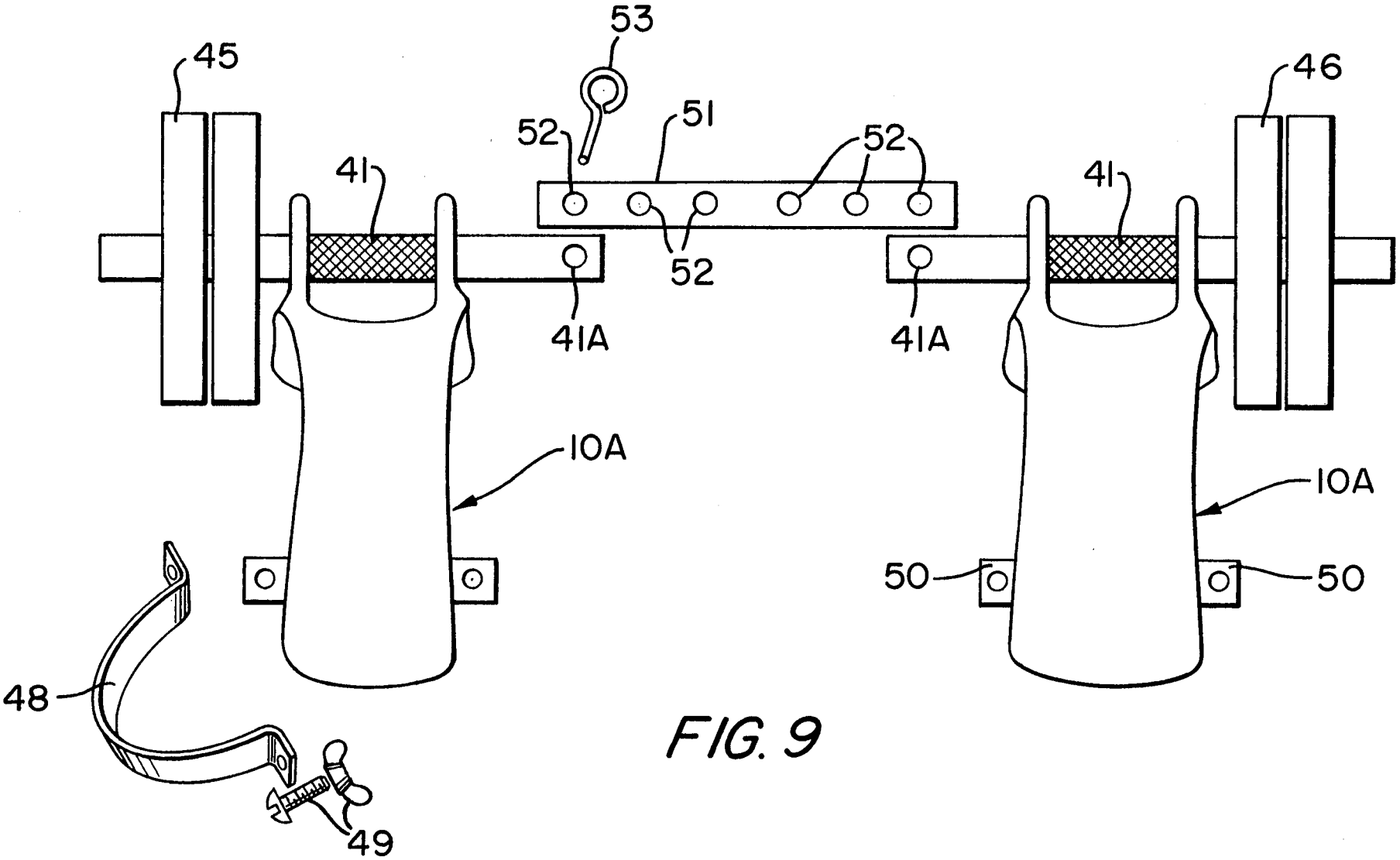
FIGS. 9, 10 and 11 show views of a further embodiment of an exercise apparatus for the upper arm in accordance with the principles of the present invention.
Figure 10:
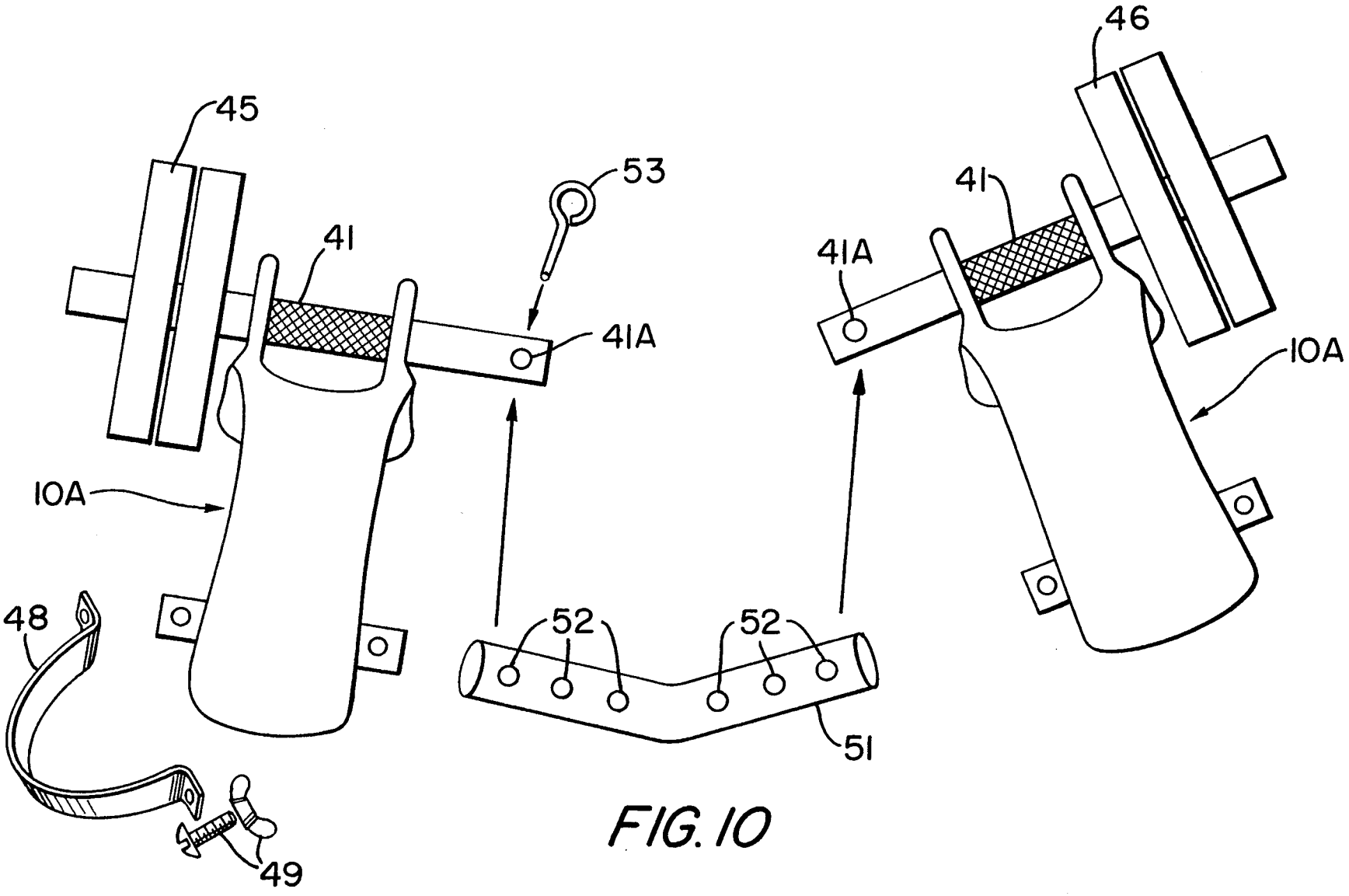
Figure 11:
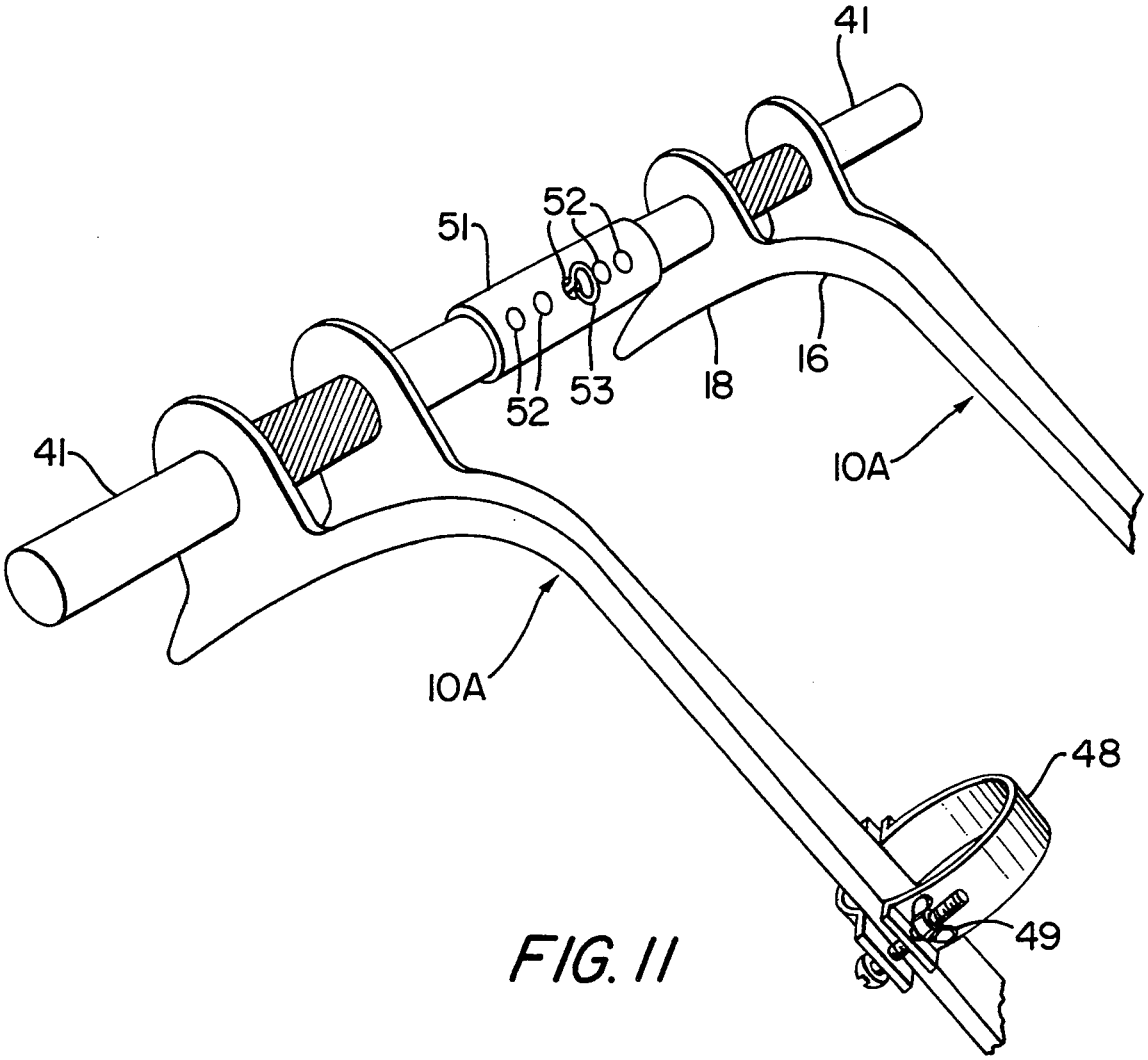

FIGS. 9–11 illustrate a third embodiment of the exercise apparatus of the invention in which the apparatus of FIGS. 5–8 has been modified so that two units are connected together to form a composite unit to be used with both hands of the user. As shown, a sleeve 51 (either straight as shown in FIG. 9 or a V-shaped as shown in FIG. 10) is used to connect together adjacent ends of the bars 41 of two exercise apparatuses of the type shown in FIGS. 5–8. The ends of the bars 41 are provided with apertures 41A which align with apertures 52 in the sleeve 51 for receiving a locking pin 53 or other locking device. This locks the bars 41 and thus the corresponding apparatuses 10A to the sleeve 51 forming a composite unit as shown in FIG. 11.

By including a number of spaced apertures 52 in the sleeve 51, various length units can be realized. This accommodates users of different size.

It should be noted that the angle e of the bend of the bent portions 14 and 14A of the apparatus 10 and 10A may be different depending upon the wrist extension desired. This angle for typical users might be set at about 20° to 70°.

In all cases it is understood that the above-described arrangements are merely illustrative of the many possible specific embodiments which represent applications of the present invention. Numerous and varied other arrangements, can be readily devised in accordance with the principles of the present invention without departing from the spirit and scope of the invention.

What is claimed is:

1. An exercise apparatus for an arm of a user, said exercise apparatus comprising:

a support including:

a first part for extending along a portion of the lower arm of said user; and a second part extending from said first part, said second part having an outwardly curved portion for supporting the wrist of said user, and said second part including a weight support portion extending from said curved portion for supporting a weight, said weight support potion extending downwardly and then extending in a curved fashion to form a hook; and a grip attached to said second part of said support and adapted to be grasped by the hand of said user when said lower arm and wrist of said user are supported in said first and second parts of said support.

2. An exercise apparatus in accordance with claim 1 wherein:

said grip comprises first and second extensions extending from the sides of said second part adjacent said curved portion and a handle connected to the upper ends of said extensions.

3. An exercise apparatus in accordance with claim 1 further comprising:

a strap attached to said first part of said support for holding said support to said lower arm of said user.

4. An exercise apparatus in accordance with claim 1 wherein:

said outwardly curved portion of said second part is at an angle of approximately 20° to 70° relative to said first part.

5. An exercise apparatus in accordance with claim 4 wherein:

said first part is substantially straight.

6. An exercise apparatus for an arm of a user, said exercise apparatus comprising:

a support including:

a first part for extending along a portion of the lower arm of said user; and a second part extending from said first part, said second part having an outwardly curved portion for supporting the wrist of said user, and said second part including a weight support portion extending from said curved portion for supporting a weight; and a grip attached to said second part of said support and adapted to be grasped by the hand of said user when said lower arm and wrist of said user are supported in said first and second parts of said support, said weight support portion includes first and second upstanding plates extending from opposite edges of said support, said first and second upstanding plates each including an aperture for receiving a bar, said bar when received in said apertures of said first and second upstanding plates forming said grip.

7. An exercise apparatus in accordance with claim 6, further comprising:

said bar, the portions of said bar outward of the space between said first and second upstanding plates providing a support for a weight.

8. An exercise apparatus in accordance with claim 6, further comprising:

said bar, a first end of said bar outward of the space between said first and second upstanding plates providing a support for a weight and the second end of said bar outward of the space between said first and second upstanding plates being adapted to receive a sleeve;

a sleeve for receiving in a first end said second end of said bar.

9. An exercise apparatus in accordance with claim 8 wherein:

said sleeve is one of straight and V-shaped.

10. An exercise apparatus in accordance with claim 8 wherein:

the second end of said sleeve is adapted to receive the second end of a further exercise apparatus.

11. An exercise apparatus in accordance with claim 6, further comprising:

a strap attached to said first part of said support for holding said support to said lower arm of said user.

12. An exercise apparatus in accordance with claim 6, wherein:

said outwardly curved portion of said second part is at an angle of approximately 20° to 70° relative to said first part.

13. An exercise apparatus in accordance with claim 12 wherein:

said first part is substantially straight.

* * * * *